US007581984B2

(12) United States Patent
Moyon et al.

(10) Patent No.: US 7,581,984 B2
(45) Date of Patent: Sep. 1, 2009

(54) MULTICONTACT CONNECTOR

(75) Inventors: Stéphane Moyon, Neuille-le-lierre (FR); Laurent Gauvrit, Saunay (FR); Emmanuel Demaret, Tours (FR)

(73) Assignee: Societe Radiall, Rosny-Sous-Bois (FR)

( * ) Notice: Subject to any disclaimer, the term of this patent is extended or adjusted under 35 U.S.C. 154(b) by 3 days.

(21) Appl. No.: 11/812,057

(22) Filed: Jun. 14, 2007

(65) Prior Publication Data

US 2008/0003886 A1 Jan. 3, 2008

(30) Foreign Application Priority Data

Jun. 28, 2006 (FR) ..... 06 05816

(51) Int. Cl.
*H01R 13/73* (2006.01)

(52) U.S. Cl. ..... 439/557; 439/903; 439/744

(58) Field of Classification Search ..... 439/903, 439/744, 557

See application file for complete search history.

(56) References Cited

U.S. PATENT DOCUMENTS 4,659,162 A 4/1987 Cartesse
4,902,235 A * 2/1990 Tonooka ..... 439/72
5,575,691 A * 11/1996 Matthews ..... 439/744

FOREIGN PATENT DOCUMENTS

EP 0 183 587 A1 6/1986

* cited by examiner

*Primary Examiner*—Tho D Ta
*Assistant Examiner*—Travis Chambers
(74) *Attorney, Agent, or Firm*—Oliff & Berridge, PLC

(57) ABSTRACT

The present invention relates to a multicontact connector comprising: a connector body presenting front and rear faces and including at least one cavity extending between the front and rear faces and opening out therein; at least one insert arranged to receive contact elements, in particular electrical or optical contact elements; and at least one retention member arranged to retain the insert in the cavity of the connector body, the retention member comprising at least one elastically deformable tab movable between a locking position preventing the insert from being withdrawn from the cavity and a retracted position enabling the insert to be withdrawn from the cavity, in particular via the rear face of the connector body, the tab having at least two bearing faces, one of which is arranged in such a manner that a force applied thereagainst and directed towards the front face of the body of the connector causes the tabs to be retracted, and another one of which is arranged in such a manner that a force applied thereagainst and directed towards the rear face of the body of the connector causes said tabs to retract.

19 Claims, 4 Drawing Sheets

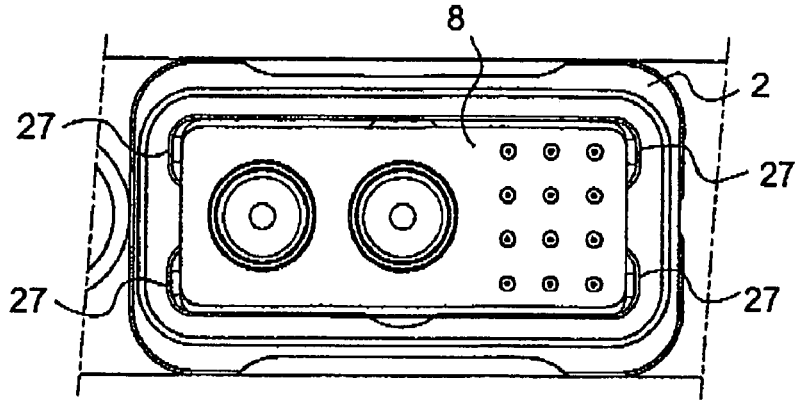
Fig.2
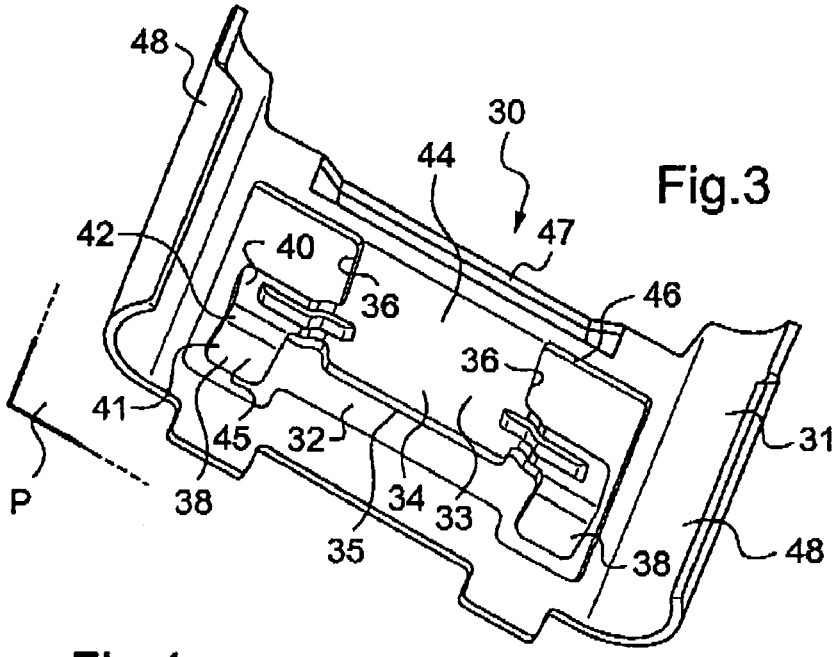
Fig.3
Fig.4
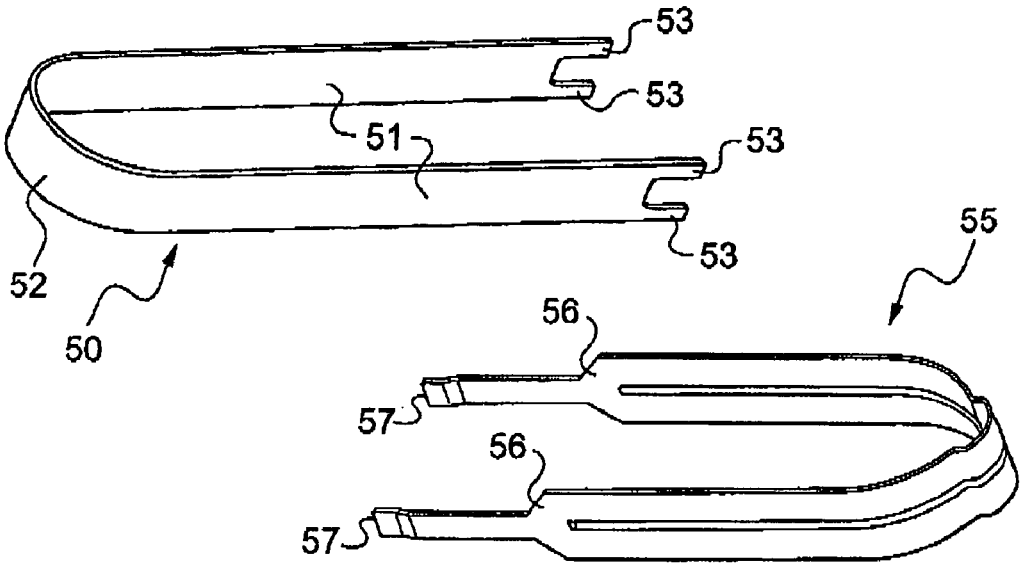
Fig.5

Fig.8
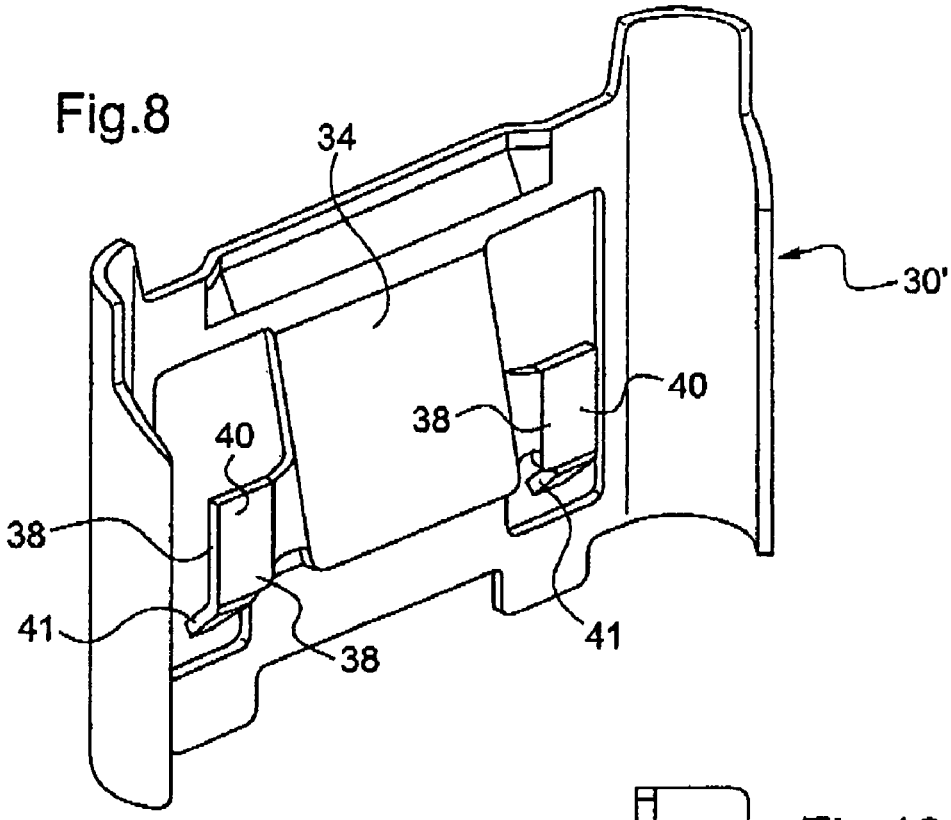
Fig.10
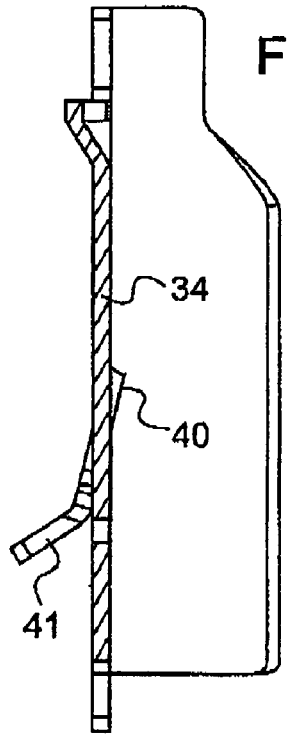
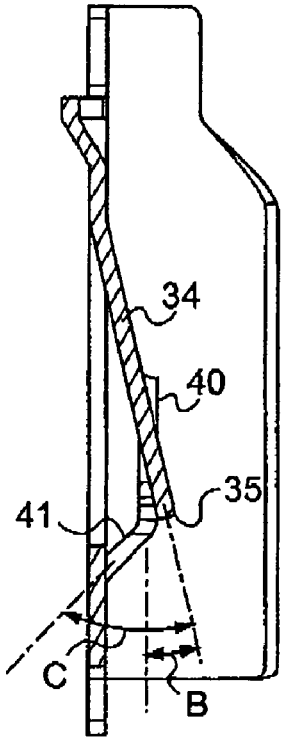
Fig.9

MULTICONTACT CONNECTOR

BACKGROUND

At present, most modular connectors used in the field of aviation are of the rear release/rear removable (RR/RR) type.

Such connectors are removed from the rear in satisfactory manner in a large number of intended utilizations.

For a multicontact connector fitted with contact elements formed by pins soldered to a printed circuit card, with said contact elements being carried by an insert disposed in a cavity of a connector body and the connector body being fastened to the card via its rear face, withdrawing the insert from the cavity becomes more difficult since it is not possible to pass an extractor tool from the rear face of the connector body. That operation requires the contact elements initially to be unsoldered from the card before it is possible to extract the insert.

Likewise, when sealing elements are provided at the rear of the cavity of the connector body, it can be difficult to pass an extractor tool from the rear face because of the presence of said sealing elements.

SUMMARY

The present invention seeks in particular to facilitate withdrawing an insert from a cavity of a connector body.

The invention thus provides a multicontact connector comprising:

- a connector body presenting front and rear faces and including at least one cavity extending between the front and rear faces and opening out therein;
- at least one insert arranged to receive contact elements, in particular electrical or optical contact elements; and
- at least one retention member arranged to retain the insert in the cavity of the connector body, the retention member comprising at least one elastically deformable tab movable between a locking position preventing the insert from being withdrawn from the cavity and a retracted position enabling the insert to be withdrawn from the cavity, in particular via the rear face of the connector body, the tab having at least two bearing faces, one of which is arranged in such a manner that a force applied thereagainst and directed towards the front face of the body of the connector causes the tabs to be retracted, and another one of which is arranged in such a manner that a force applied thereagainst and directed towards the rear face of the body of the connector causes said tabs to retract.

By means of the invention, it is possible to withdraw the insert from the cavity of the connector body by inserting an extractor tool from the rear face or from the front of the connector body in order to act on the tab so as to retract it.

The invention makes it easy to withdraw the insert from the cavity by passing an extractor tool from the front face, in particular when the connector includes contact elements soldered to a printed circuit card placed against the rear face of the connector body, or when the connector includes rear sealing elements that make it difficult to pass an extractor tool.

Whether the extractor tool is passed from the front face or from the rear face of the connector body, the insert is preferably always withdrawn from the cavity from the rear face of the connector body.

By way of example, the connector of the invention may be of the same type as connectors in the EPX A and B range sold by the supplier Radiall.

By way of example, the contact elements may be male or female electrical contact elements, or in a variant they may be optical contact elements.

The connector of the invention, whether of the electrical, optical, or opto-electrical type, can be used in the field of aviation, for example.

Advantageously, the tab includes at least one bearing edge, in particular an edge that is substantially rectilinear, which edge is arranged to bear against a shoulder of the insert, in order to retain the insert in the cavity of the connector body.

Preferably, the tab comprises:

- at least one locking tongue defining the front of the bearing edge and including at least one side edge; and
- one or more actuator elements for actuating the locking tongue connected thereto via its side edge, a bearing face being formed on the or each actuator element enabling the elastically deformable tab to be retracted by exerting on said bearing face a force that is directed towards the rear face of the connector body.

The bearing and side edges of the locking tongue may be substantially perpendicular.

Advantageously, the locking tongue defines the bearing face enabling the tab to be retracted by exerting on said bearing face a force that is directed towards the front face of the connector body.

In an embodiment of the invention, the locking tongue has two side edges, in particular parallel edges, each having an actuator element connected thereto.

In a variant, the tab may have only one actuator element.

The actuator element may in particular be bent.

The actuator element may comprise a first portion extending substantially parallel to the locking tongue and a second portion co-operating with the first portion to define the bend of the actuator element.

In a variant, the actuator element comprises a first portion that is inclined relative to the locking tongue and a second portion co-operating with the first to define the bend of the actuator element, the second portion sloping more steeply relative to the locking tongue than the first.

This enables the lever effect to be increased at the bearing edge so as to make it easier to remove the cavity when the extractor tool is inserted from the front face.

In an embodiment of the invention, the actuator element extends beyond the bearing edge of the locking tongue.

By way of example, at least one of the bearing faces, and in particular both of them, is/are substantially plane.

The bearing faces enabling the tab to be retracted respectively from the front and rear faces of the connector body form between them an angle that lies in particular in the range 30° to 90°, and in particular is equal to about 60°.

Preferably, the retention member comprises a frame and the elastically deformable tab is connected to an inside edge of the frame.

The locking tongue advantageously forms an angle relative to the main plane of the frame that lies in particular in the range 5° to 30°, for example that is about 15°.

Advantageously, the frame includes a step arranged to bear against a shoulder of the connector body.

For example, the frame includes one and in particular two side portions, each being substantially rounded in shape.

In an embodiment of the invention, the connector body has an inside wall defining the cavity, the wall having one or more setbacks arranged to receive at least in part the or each actuator element of the elastically deformable tab when retracted.

Advantageously, the connector body has one or more setbacks giving access to the actuator element(s) of the tab from the front face of the connector body.

The retention member is made by cutting out sheet metal, for example.

The invention also provides a retention member for a connector, the retention member comprising at least one elastically deformable tab movable between a locking position preventing the insert from being withdrawn from the cavity and a retracted position enabling the insert to be withdrawn from the cavity, the tab including at least two bearing faces, said faces being arranged in such a manner that a force applied to one of said faces and directed towards the front face of the connector body, or a force applied to the other of said faces and directed towards the rear face of the connector body causes the tabs to be retracted.

The invention also provides an extractor tool arranged to bear against the retention member of a connector as defined above, with a force enabling the elastically deformable tab of the retention member to be retracted, the tool being arranged to be capable of being applied against the tab by passing through the front face of the connector body.

Advantageously, the tool includes at least one branch, and in particular two substantially parallel branches, with two projections at the end of the or each branch for engaging in two openings formed in the connector body and accessible from the front face.

The invention also provides a method of removing an insert from a connector body in a connector as defined above, the method comprising the following steps:

exerting a force, in particular with the help of an extractor tool, from the front face of the connector body on the tab of the retention member, in particular on one or more actuator elements of the tab, so as to cause the tab to retract; and withdrawing the insert through the rear face of the connector body.

By way of example, the connector has its rear face secured to a printed circuit card.

The invention also provides a method of removing an insert from a connector body in a connector as defined above, the method comprising the following steps:

exerting a force, in particular with the help of an extractor tool, from the rear face of the connector body, against the tab of the retention member in order to retract it; and withdrawing the insert through the rear face of the connector body.

BRIEF DESCRIPTION OF THE DRAWINGS

The invention can be better understood on reading the following detailed description of non-limiting embodiments of the invention, and on examining the accompanying drawings, in which:

FIG. 2 is a diagrammatic and fragmentary face view of the FIG. 1 connector;

FIG. 3 is a diagrammatic and fragmentary perspective view of a retaining member in an embodiment of the invention;

FIGS. 4 and 5 are diagrammatic and fragmentary perspective views of two extractor tools;

FIG. 8 is a diagrammatic and fragmentary perspective view of a retaining member in another embodiment of the invention; and FIGS. 9 and 10 are diagrammatic and fragmentary section views showing the tab of the FIG. 8 retaining member, respectively in a rest position and in a retracted position.

MORE DETAILED DESCRIPTION

Figure 1:
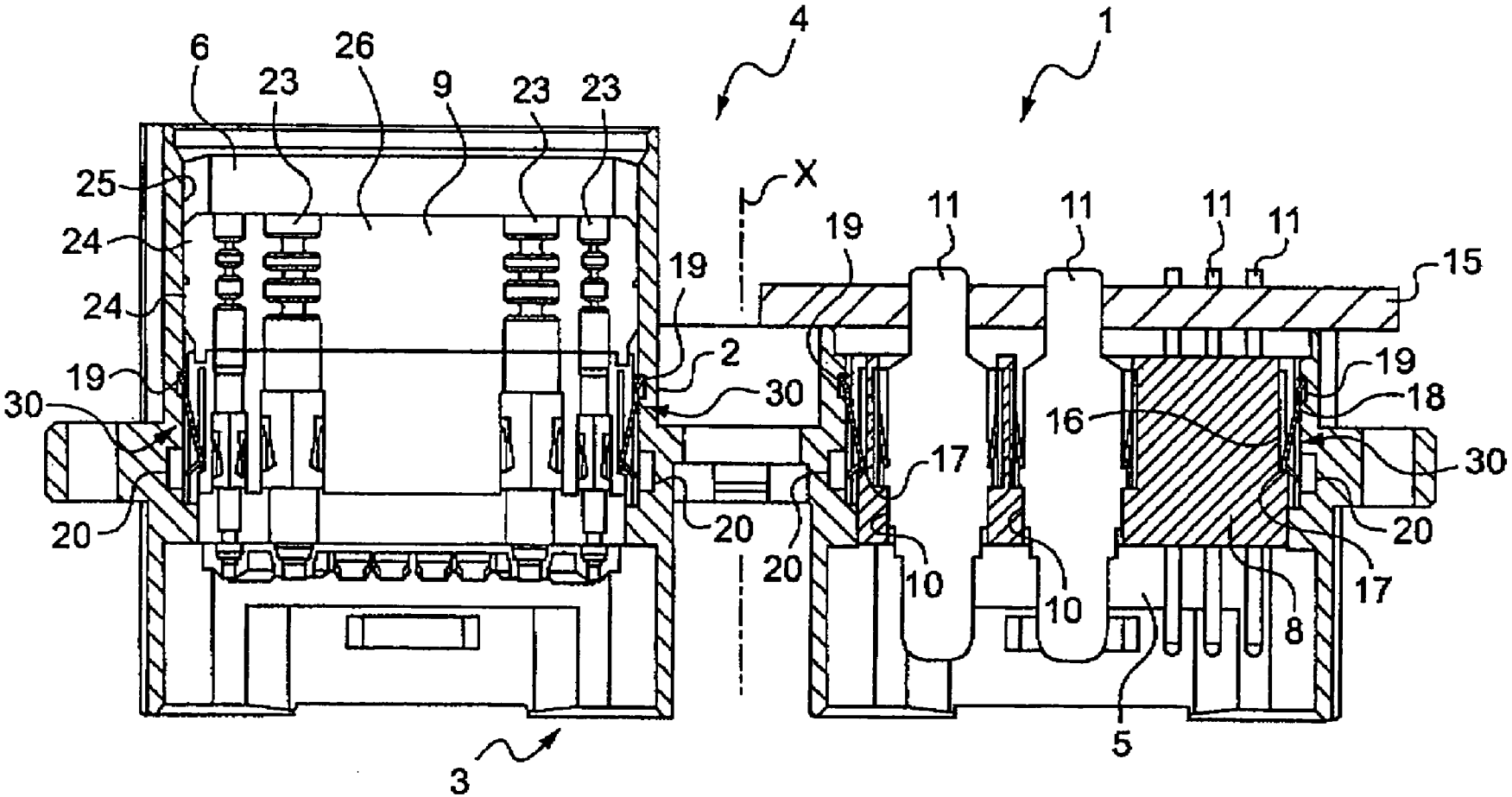
FIG. 1 is a diagrammatic and fragmentary view in longitudinal section of a connector constituting an embodiment of the invention.

FIG. 1 shows a multicontact connector 1 comprising:

a connector body 2 presenting front and rear faces 3 and 4 and having two cavities 5 and 6 of axis X extending between the front and rear faces 3 and 4 and opening out therein, the body 2 being made of metal or of composite material, for example; and inserts 8 and 9 engaged respectively in the cavities 5 and 6.

The insert 8 includes a plurality of housings 10, each serving to receive a respective electrical contact element, e.g. in the form of pins 11, which may present various diameters.

A printed circuit card 15 is fastened to the rear face 4 of the connector body 2, over the cavity 5.

The contact elements 11 are soldered to this printed circuit card 15.

The insert 8 has a side wall 16 having shoulders 17 formed thereon that extend substantially perpendicularly to the axis X.

The cavity 5 is defined by an inside wall 18 of the connector body 2.

Facing grooves 19 and likewise facing setbacks 20 are formed in the wall 18, the grooves 19 being situated between the setbacks 20 and the rear face 4.

The insert 9 includes a plurality of housings 23 that may be of at least two different types, or in a variant that may be identical, the housings being arranged to receive electrical or optical contact elements.

The insert 9 includes annular ribs 24 that press against an inside wall 25 defining the cavity 6, so as to provide through sealing between the front and rear faces 3 and 4.

The sealing ribs 24 are made for example on a rear portion 26 of elastomer material of the insert 9.

Grooves 19 and setbacks 20 are formed in the inside wall 25, as described above for the wall 18.

As can be seen in FIG. 2, the connector body 2 forms four openings 27 in the front face 3 around the insert 8 for a purpose that is explained below.

The inserts 8 and 9 are retained in their respective cavities 5 and 6, each by means of a pair of retention members 30.

As shown in FIG. 3, each retention element 30 comprises a frame 31 defining a window 32 in which there extends an elastically deformable tab 33 movable between a locking position preventing the insert 8 or 9 being withdrawn from the corresponding cavity 5 or 6, and a retracted position enabling the insert 8 or 9 to be withdrawn from the cavity 5 or 6 through the rear face 4.

The tab 33 has a generally plane locking tongue 34 defining a bearing edge 35 at the front and including two side edges 36 that are substantially parallel to each other.

The locking tongue 34 is connected to the frame 31 along an inside edge 46 of the frame 31.

The tab 33 also has two actuator elements 38, each connected to the locking tongue 34 via a side edge 36;

In the example shown, each actuator element 38 is bent, comprising a first portion 40 extending substantially parallel to the locking tongue 34, and a second portion 41 co-operating with the first portion 40 to define the bend 42 of the actuator element 38.

The first portion 40 is connected to the locking tongue 34.

The second portions 41 of the actuator elements 38 extend beyond the bearing edge 35 of the locking tongue 34.

In the rest position, the locking tongue 34 makes an angle relative to a main plane P of the frame 31 that lies in particular in the range 5° to 30°, for example being about 15°.

Figure 7:
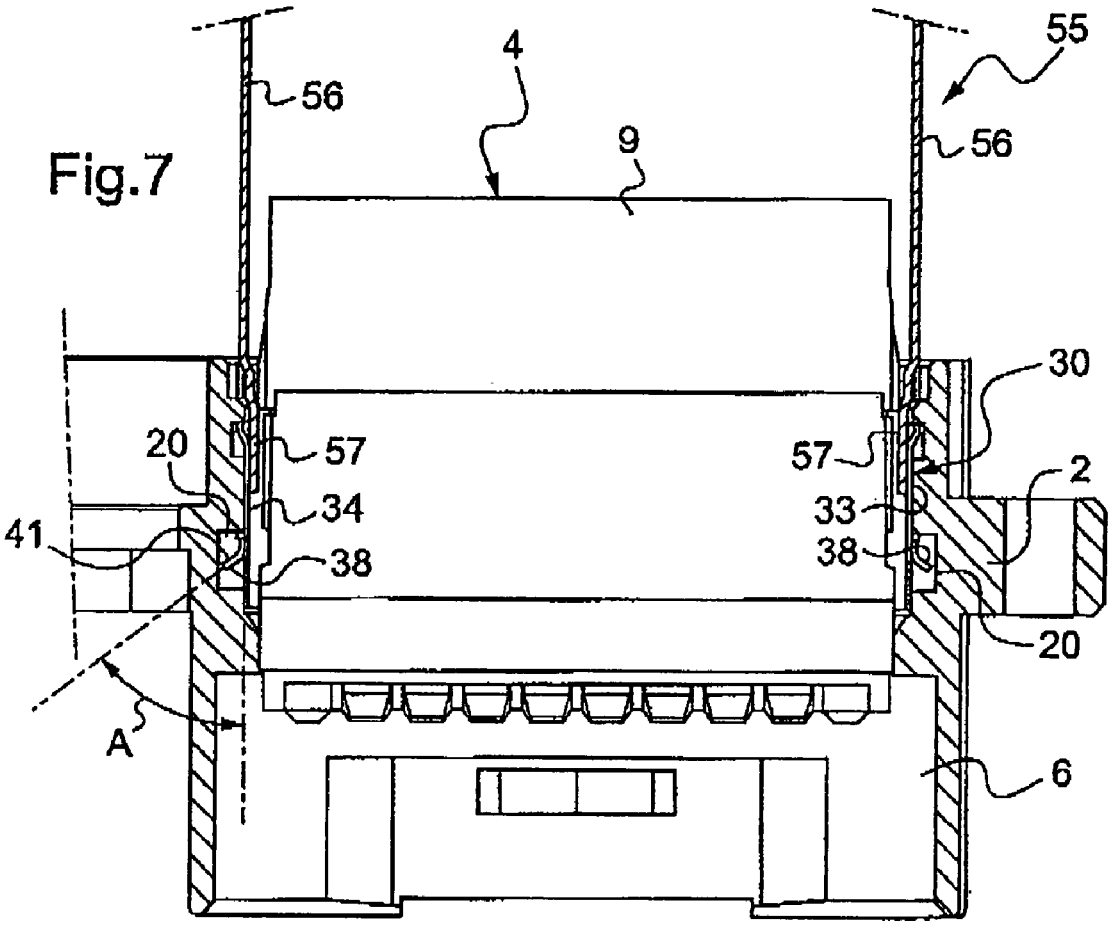
FIG. 7 is a diagrammatic and fragmentary longitudinal section view of a connector constituting an embodiment of the invention, with an extractor tool inserted via its rear face.

The second portion 41 of the actuator element 38 forms an angle A relative to the locking tongue 34 that is equal to about 60°, as shown in FIG. 7.

Each locking tongue 34 and each second portion 41 of the actuator element 38 defines a respective bearing face 44 or 45, each of the faces 44 and 45 being arranged in such a manner that a force applied to said face 44 or 45 and respectively directed towards the front face 3 or towards the rear face 4 of the connector body 2 causes the tab 33 to be retracted.

The frame 31 includes a step 47 arranged to press against a shoulder formed in a groove 19 of the connector body 2.

The frame 31 also has two side portions 48, each being of substantially rounded shape so as to match substantially the shape of the inside wall 18 or 25.

In the locking position, the locking tabs 33 press against the shoulders 17 of the inserts 8 and 9, serving to prevent the insert 8 or 9 from being withdrawn via the rear face 4 of the connector body 2, as can be seen in FIG. 1.

FIG. 4 shows an extractor tool 50 in accordance with an embodiment of the invention suitable for acting on the locking tabs 33 so as to bring them into a retracted position.

The tool 50 comprises two substantially rectilinear and parallel branches 51 that are connected together by a rounded portion 52.

Two projections 53 are provided at the free end of each of the branches 51.

FIG. 5 shows an extractor tool 55 comprising two substantially rectilinear and parallel branches 56 each having a substantially rectilinear tip 57 at its end.

There follows a description of the operations for extracting an insert 8 or 9 from the corresponding cavity 5 or 6.

When withdrawing the insert 8 from the cavity 5, it should be observed that inserting an extractor tool via the rear face 4 is made difficult because of the presence of the printed circuit card 15.

In order to retract the elastically deformable tabs 33 of the retention members 30, thus enabling the insert 8 to be withdrawn from the cavity 5, the extractor tool 50 is inserted via the front face 3 in such a manner that the projections 53 penetrate into the openings 27.

By pushing on the extractor tool 50, the projections 53 exert a force on the bearing faces 45 of the actuator elements 38, thereby tending to cause the tab 33 to pivot away from the bearing edge 35 of the corresponding shoulder 17.

Figure 6:
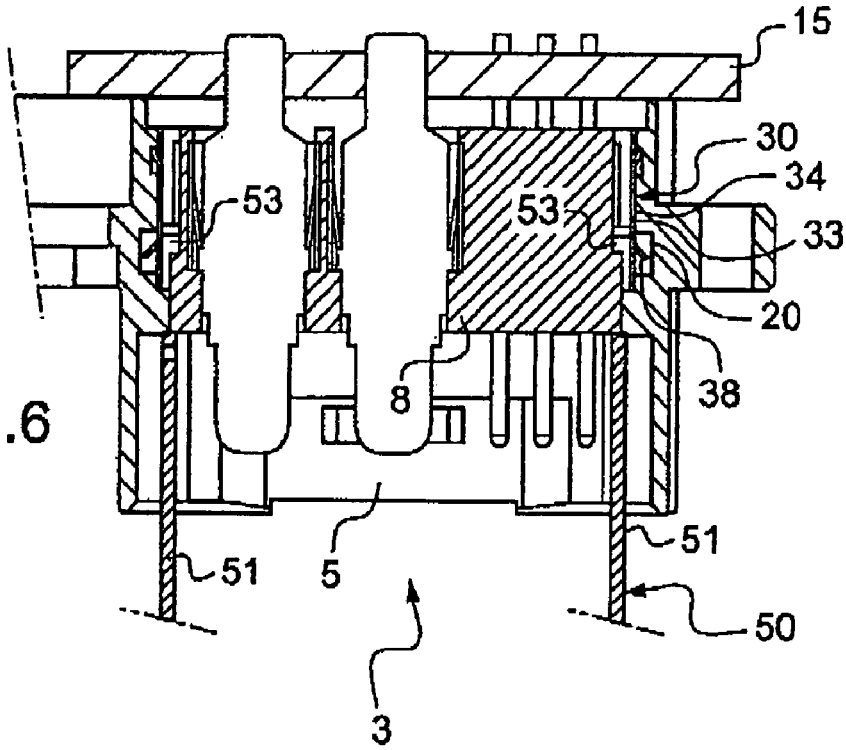
FIG. 6 is a diagrammatic and fragmentary longitudinal section view of the FIG. 1 connector with an extractor tool inserted via its front face.

The actuator elements 38 thus retract into the corresponding setbacks 20, as shown in FIG. 6.

It is then possible to extract the insert 8 from the cavity 5.

The insert 9 is extracted from the cavity 6 in the same manner, by inserting the extractor tool 50 via the front face 3.

When the insert 8 does not have sealing ribs 24, there is sufficient space at the rear face 4 to enable the extractor tool 55 to be used to exert a force on the bearing faces 44 of the unlocking tongues 34 so as to retract the tab 33, as shown in FIG. 7.

Naturally, the invention is not limited to the embodiments described above.

For example, the elastically deformable tab 33 could comprise a locking tongue 34 and only one actuator element 38.

If so desired, the connector body 2 could have a single cavity 5 or 6.

FIG. 8 shows a retention member 30' constituting another embodiment of the invention, differing from the above-described retention member 30 by the fact that the first portion 40 of each actuator element 38 extends in a manner that is not parallel relative to the locking tongue 34.

As can be seen in FIGS. 8 to 10, the first portion 40 forms an angle B with the tongue 34, e.g. having a value of about 15°, and the second portion 41 forms an angle C of about 55° with the locking tongue 34.

The angular disposition of the portions 40 and 41 serves to increase the lever effect at the bearing edge 35 of the locking tongue 34 so as to make it easier to remove the insert when the extractor tool is inserted via the front face of the connector body.

Although the present invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A multicontact connector comprising:

a connector body presenting front and rear faces and including at least one cavity extending between the front and rear faces and opening out therein;

at least one insert arranged to receive electrical or optical contact elements; and at least one retention member arranged to retain the insert in the cavity of the connector body, the retention member comprising at least one elastically deformable tab movable between a locking position preventing the insert from being withdrawn from the cavity and a retracted position enabling the insert to be withdrawn from the cavity, via the rear face of the connector body, the tab having at least two bearing faces, a first bearing face of the two bearing faces being arranged in such a manner that a force applied thereagainst and directed towards the front face of the body of the connector causes the tabs to be retracted, and a second bearing face of the two bearing faces being arranged in such a manner that a force applied thereagainst and directed towards the rear face of the body of the connector causes said tabs to retract, wherein the first and second bearing faces are substantially planar, wherein the tab includes at least one bearing edge that is substantially rectilinear, the bearing edge being arranged to bear against a shoulder of the insert, wherein the tab comprises:

at least one locking tongue defining the front of the bearing edge and including at least one side edge; and at least one actuator element for actuating the locking tongue connected thereto via its side edge, a bearing face being formed on the actuator element enabling the elastically deformable tab to be retracted by exerting on said bearing face a force that is directed towards the rear face of the connector body.

2. A connector according to claim 1, wherein the bearing and side edges of the locking tongue are substantially perpendicular.

3. A connector according to claim 1, wherein the locking tongue defines the bearing face enabling the tab to be retracted by exerting on said bearing face a force that is directed towards the front face of the connector body.

4. A connector according to claim 1, wherein the locking tongue has two side edges, in particular parallel edges, each having an actuator element connected thereto.

5. A connector according to claim 1, wherein the actuator element extends beyond the bearing edge of the locking tongue.

6. A connector according to claim 1, wherein the connector body has an inside wall defining the cavity, the wall having one or more setbacks arranged to receive at least in part the or each actuator element of the elastically deformable tab when retracted.

7. A connector according to claim 1, wherein the connector body has one or more setbacks giving access to the actuator element(s) of the tab from the front face of the connector body.

8. A retention member for a connector according to claim 1, the member comprising at least one elastically deformable tab movable between a locking position preventing the insert from being withdrawn from the cavity and a retracted position enabling the insert to be withdrawn from the cavity, the tab including at least two bearing faces, said faces being arranged in such a manner that a force applied to one of said faces and directed towards the front face of the connector body, or a force applied to the other of said faces and directed towards the rear face of the connector body causes the tabs to be retracted.

9. A method of removing an insert from the connector body in the connector according to claim l, the method comprising the following steps:

exerting a force from the rear face of the connector body against the tab of the retention member in order to retract it; and withdrawing the insert via the rear face of the connector body.

10. A connector according to claim 1, wherein the actuator element is bent.

11. A connector according to claim 10, wherein the actuator element comprises a first portion extending substantially parallel to the locking tongue and a second portion co-operating with the first portion to define the bend of the actuator element.

12. A connector according to claim 10, wherein the actuator element comprises a first portion that is inclined relative to the locking tongue and a second portion co-operating with the first to define the bend of the actuator element, the second portion sloping more steeply relative to the locking tongue than the first.

13. An extractor tool arranged to bear against the retention member of a connector according to claim 1 with a force enabling the elastically deformable tab of the retention member to be retracted, the tool being arranged to be capable of being applied against the tab by passing through the front face of the connector body.

14. A tool according to claim 13, wherein includes at least one branch, and in particular two substantially parallel branches, with two projections at the end of the or each branch for engaging in two openings formed in the connector body.

15. A method of removing the insert from the connector body in the connector according to claim 1, the method comprising the following steps:

exerting a force from the front face of the connector body against the tab of the retention member in order to retract it; and withdrawing the insert via the rear face of the connector body.

16. A method according to claim 15, wherein the connector has its rear face secured to a printed circuit card.

17. A mulitcontact connector comprising:

a connector body presenting front and rear faces and including at least one cavity extending between the front and rear faces and opening out therein;

at least one insert arranged to receive electrical or optical contact elements; and at least one retention member arranged to retain the insert in the cavity of the connector body, the retention member comprising at least one elastically deformable tab movable between a locking position preventing the insert from being withdrawn from the cavity and a retracted position enabling the insert to be withdrawn from the cavity, via the rear face of the connector body, the tab having at least two bearing faces, a first bearing face of the two bearing faces being arranged in such a manner that a force applied thereagainst and directed towards the front face of the body of the connector causes the tabs to be retracted, and a second bearing face of the two bearing faces being arranged in such a manner that a force applied thereagainst and directed towards the rear face of the body of the connector causes said tabs to retract, wherein the first and second bearing faces are substantially planar, wherein the retention member comprises a frame, and wherein the elastically deformable tab is connected to an inside edge of the frame.

18. A connector according to claim 17, wherein the frame includes a step arranged to bear against a shoulder of the connector body.

19. A connector according to claim 17, wherein the frame includes two side portions, each being substantially rounded in shape.

* * * * *